US007198091B2

(12) United States Patent
Yakubovich

(10) Patent No.: US 7,198,091 B2
(45) Date of Patent: Apr. 3, 2007

(54) METHOD FOR SECURING GEMSTONES IN AN EFFECTIVELY INVISIBLE SETTING

(75) Inventor: Nicolay Yakubovich, Great Neck, NY (US)

(73) Assignee: MJJ Brilliant, Inc., New York, NY (US)

( * ) Notice: Subject to any disclaimer, the term of this patent is extended or adjusted under 35 U.S.C. 154(b) by 530 days.

(21) Appl. No.: 10/812,126

(22) Filed: Mar. 29, 2004

(65) Prior Publication Data

US 2005/0210677 A1 Sep. 29, 2005

(51) Int. Cl.
*B22C 7/02* (2006.01)
*B22C 9/04* (2006.01)

(52) U.S. Cl. ..... 164/35; 164/45; 164/516

(58) Field of Classification Search ..... 164/34–36, 164/45, 516–519
See application file for complete search history.

(56) References Cited

U.S. PATENT DOCUMENTS 4,819,453 A 4/1989 McNamara ..... 63/28
5,218,839 A 6/1993 Udko ..... 63/26
5,437,167 A 8/1995 Ambar ..... 63/26
5,488,839 A 2/1996 Udko ..... 63/28
5,690,477 A * 11/1997 Haimoff ..... 164/9
6,112,552 A 9/2000 Hoffman ..... 63/26
6,516,864 B2 2/2003 Ounjian et al. ..... 164/35

* cited by examiner

*Primary Examiner*—Kuang Y. Lin
(74) *Attorney, Agent, or Firm*—McCarter & English, LLP

(57) ABSTRACT

The invention relates to a method for producing an effectively invisible gemstone setting by casting a wax model of the setting and inserting a flange or post between the stones and into the floor of the setting, or into a depression or aperture on the floor of the setting, in order to secure the stones placed in the wax model of the setting. The flange is shaped so that the majority of its body is hidden beneath the gemstones and so that a narrowed portion of the flange engages the sides or girdles of the gemstones. The upper portion of the flange has sloped sides and may reflect light to and from the crown of the gemstones mounted in the setting.

18 Claims, 4 Drawing Sheets

METHOD FOR SECURING GEMSTONES IN AN EFFECTIVELY INVISIBLE SETTING

FIELD OF THE INVENTION

This invention relates to the methods used to produce jewelry with gemstones mounted in settings. Specifically, the invention relates to a method for producing an effectively invisible setting for gemstones.

BACKGROUND OF THE INVENTION

The invisible jewelry setting is one of the more aesthetically pleasing and commercially popular jewelry settings available today. Gemstones placed within an invisible setting are secured to the setting at points beneath their crowns, so that the setting presents an unobstructed view of essentially all of the upper surface of the gemstone. The gemstones' crowns in turn receive more incoming, incident light than gemstones set in a comparable ordinary setting, increasing the stones' refractive fire or sparkle. As a result, the gemstones placed in an invisible setting are displayed to great effect to the jewelry's purchaser, wearer and viewer.

The lost wax casting technique is a widely known method for producing jewelry with invisible jewelry settings. Generally, the lost wax technique for producing jewelry involves producing wax model copies of a master setting, and mounting the gemstones in the wax model copies. Typically, the wax models are then encased in a liquid or slurry of investment material to form a mold. After the mold hardens, the wax is removed leaving the gemstones in the mold. The cavity in the mold left by the wax is then filled with a molten precious metal, such as a jewelry grade alloy of gold. The metal hardens as it cools, encasing and securing the gemstones in a jewelry setting that is nearly identical to the wax model used to produce the mold.

Thus, to apply this technique to produce a conventional invisible setting, the gemstones set into the wax models must precisely match those originally used in the master. In a conventional invisible setting, the gemstones are mounted upon fine protrusions that extend from an anchor on the setting floor into cavities cut into the gemstones. The step of mounting the stones in the wax model must be preceded by the step of cutting cavities within the gemstones that are identical to the cavities originally cut in the stones placed in the master setting. In addition, the wax models must be formed with anchors that precisely match the anchors in the master. The stones must then be carefully mounted on the wax anchors to avoid damaging their fine protrusions. Small variances in the wax models, damage to the anchors, or variation in the gemstones' size, shape or the pre-cut cavities can produce jewelry with improperly set gemstones. Since the anchors and cavities are entirely concealed within the wax model and setting after the gemstones have been placed, quality control of the conventional invisible settings during production can be problematic.

The conventional methods for producing conventional invisible settings are time consuming and require extensive use of highly skilled labor. The step of cutting grooves or other inclusions into the gemstones often requires the employment of a skilled lapidary. The step of mounting the gemstones on the wax model similarly should be performed with great care in order to avoid damage to the anchors, and a lapidary or jeweler is also typically required to perform this step.

Other methods for producing jewelry settings generally similar to the conventional invisible setting, such as those used to produce channel-style settings, do not produce settings with the same esthetic qualities of the conventional invisible setting. In these channel settings, several rows of gemstones are mounted in a series of adjacent rows or channels. Unfortunately, conventional methods for producing channel settings mount the stones in part using an interior wall between the rows that is clearly visible to the wearer and partially obstructs incident light.

For example, U.S. Pat. No. 6,516,864 discloses a method and tool for setting gems in a multiple channel setting where a groove is cut into the walls of the channels in the wax model instead of into the gems. The gems are snapped into place in the wax model by forcing them into the channel. The thickness of the walls is such that the walls are not damaged when the stones are forced into the channel. The grooves are also cut at different levels in the adjacent rows, so that the interior walls extend above the upper surface of at least one of the rows of stones. As a result, the wall between the rows of stones extends above the upper surface of at least some of the stones, partially obstructing the gemstones from incident light.

Although conventional invisible channel settings are also known, however, the methods for producing these settings entail the same problems as other conventional invisible settings. In particular, in a conventional invisible channel setting all of the girdles of the stones abut one another or the walls of the setting. Protrusions on anchors on the floor of the channel engage precisely cut grooves or other inclusions pre-cut on the pavilions of the gemstones, all of which are entirely concealed beneath the gemstone. As a result, the methods for producing conventional invisible channel settings have the same cost, labor and quality control problems as other conventional invisible channel settings.

Thus, there is a need in the art for a method of producing an effectively invisible setting that securely attaches gemstones to the setting in a cost effective manner despite minor variations in size and shape, and that still retains the pleasing and commercially valuable esthetics of a conventional invisible setting.

SUMMARY

The invention provides a method of producing an effectively invisible jewelry setting, also referred to a faux invisible setting, that can be efficiently performed to produce jewelry of high and consistent quality, allows for gemstones having a wider variation in shape and size than current methods, and that eliminates the problems associated with the step of cutting grooves into the sides or pavilion of the gemstone.

In one aspect of the invention, the invention includes a method of producing a faux invisible setting using the lost wax technique, comprising: producing a wax model of the jewelry setting, placing one or more gemstones in the setting, and adding a flange for securing the stones to the wax model of the setting. In one embodiment, the invention is a method of securely mounting gemstones into an effectively invisible jewelry setting using the lost wax casting technique, including the steps of:

- producing a wax model of the jewelry setting with two substantially parallel walls and a floor;
- placing a plurality of gemstones in said wax model,
- adding a flange for securing the gemstones to the wax model, so that the flange is placed between the gemstones and extends to a height above the floor of the wax model to a height above the plane formed by the girdles of the gemstone, forming a mold from the wax model, removing the wax model from the mold, thereby forming a mold cavity, and filling the mold cavity with molten metal to produce a jewelry setting having a metal flange for securing the gemstones substantially but not entirely concealed beneath the gemstones.

In one embodiment, the flange has two grooves for securing the girdles of the gemstones to the setting located between the upper and lower portions of the flange. The flange is made of wax, and has an upper portion with sloped sides that extends above the girdles of the gemstones. In one embodiment, the sloped sides form a ridge above the plane formed by the girdles of the gemstones, but preferably not substantially above (relative to the floor of the setting) the plane formed by the uppermost points or tables of the gemstones. In one embodiment, the sloped sides form a ridge that is between the plane of the girdles and the plane of the uppermost points of the gemstones.

In one embodiment, the wax model of the setting includes a floor bounded by parallel opposing walls that form an open channel, and the floor has an axial indentation or aperture for receiving the flange. A groove for receiving the girdles of the gemstones is located on the interior surface of the walls of the channel, and the depression or aperture for receiving the flange on the floor of the channel is slot-shaped for receiving the bottom of the flange.

In one embodiment, the flange has a base and a head separated by a narrowed portion, and the method includes inserting the base of the flange from the top of the channel, between the gemstones, and into a slot shaped depression or aperture on the floor of the setting so that the girdles of the gemstones are seated into two rabbet shaped grooves on the sides of the flange.

In one embodiment, the method includes inserting the flange between the rows of gemstones from an opening in the side of the channel, so that the base is inserted into a slot on the channel floor, and rabbets on the side of the flange slide between and engage the girdles of the rows of the gemstones.

In one embodiment, the head of the flange that extends above the girdle of the gemstones, and has an arrow-head shaped cross section. In the jewelry setting produced by the method, the sides of the flange are sloped at an angle so that the light incident to the sides of the flange is substantially reflected onto the gemstones, and light reflected or refracted by the gemstone onto the sides of the flange is substantially reflected towards the viewer, thereby increasing the incident light upon the gemstones and making the flange less noticeable to a viewer of the jewelry. In one embodiment, after the effectively invisible setting is produced from the wax model of the setting, the portion of the setting that corresponds to the sides of the head of the flange is coated with a highly reflective metal to make it less noticeable to the viewer.

DETAILED DESCRIPTION OF THE INVENTION

The present invention relates to a method for producing an effectively invisible or faux invisible setting using the lost wax casting technique. A faux invisible setting is one where the structure that secures the gemstones to the setting is effectively but not wholly concealed beneath the gemstones. Instead, part of the structure is visible upon close inspection, but is shaped and positioned so that it is relatively unnoticeable. The method for producing a faux invisible setting generally includes the following steps: producing a wax model of the jewelry setting; placing gemstones in the wax model of the setting; adding a flange for securing the gemstones to the wax model; producing a mold from the wax model; removing the wax model from the mold; filling the mold with a molten metal, and, after the metal has cooled, divesting the setting from the mold. The setting may be integrally formed with the body of the jewelry or finished into a larger jewelry item at a later time, so that the method may conveniently be used to produce a variety of jewelry items including rings, earrings, brooches, bracelets, necklaces, and pendants.

The master setting used to produce the wax model of a faux invisible channel setting may be crafted to include the channel enclosure and the mounting apertures for securing the gemstones and the flange. The master setting of a faux invisible channel setting would thus include a floor bounded by two substantially parallel walls, an aperture (e.g. a depression, hole, cavity or partial perforation in the surface) for receiving the flange located on the floor of the wax model of the setting. Preferably, a groove shaped aperture for receiving the girdles of the gemstones located on the interior surfaces of the parallel channel walls. Wax models produced from this master setting would therefore include a slot on the channel floor and a groove on the channel walls, however, it is further contemplated that the master may omit these apertures. Instead, the apertures can be placed in the wax model, for example, by modifying the mold made from the master setting before filling it with wax, or by cutting or pressing the apertures into the wax models after they are made.

Wax models suitable for use with the present invention may be produced from the master setting using a variety of techniques. In one technique, blocks of a malleable polymer material are pressed around the master until the blocks conform to the master setting. The blocks are separated and the master is removed, leaving a cavity in the polymer blocks that corresponds to the master. The blocks are rejoined, and the cavity is filled with hot liquid wax. When the wax cools, it solidifies and forms a wax model of the master setting. Depending on the exact method used, additional steps may also be employed to refine wax model, either to remove sprue marks or other gross defects or to place the apertures in the wax model's walls and floor.

Figure 1:
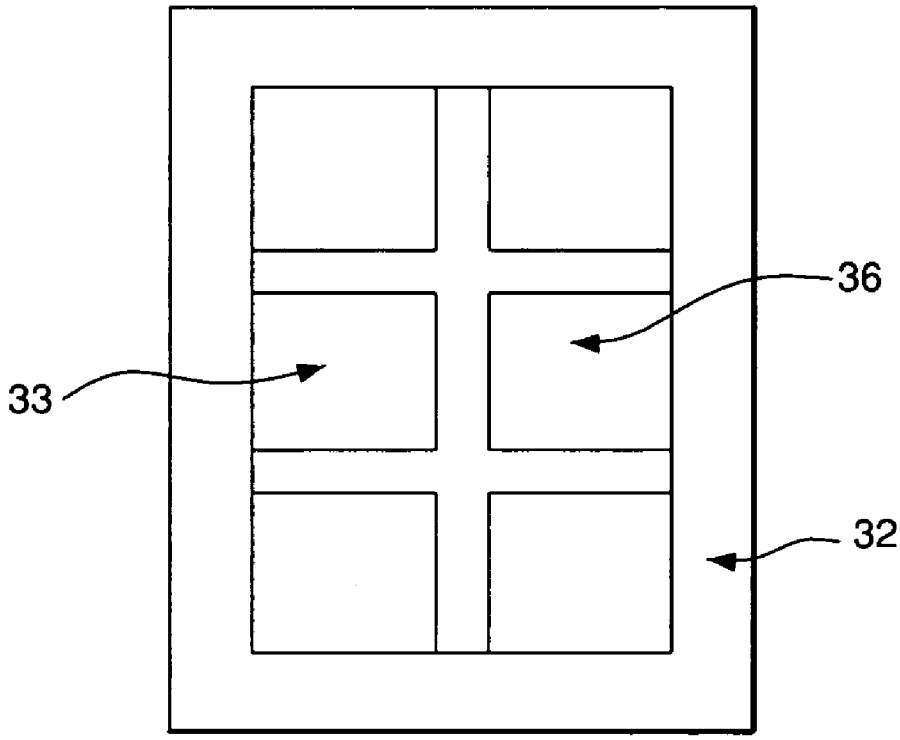
FIG. 1 depicts an overhead view of a wax model of the setting used to produce a simple faux invisible channel setting for two rows of gemstones.

FIG. 1 depicts a magnified overhead view of a wax model used to produce a simple faux invisible channel setting 30. The wax model includes a wall 32 having two to four substantially parallel sections and a setting floor 33, partially enclosing a rectangular shaped channel cavity 36 that is open at the top, and generally cubic-rectangular in shape. For reference herein, the orientation of the wax model 30 and channel cavity 36 is described as having a length as the distance of the long axis of the channel floor 33 or wall 32, a width as the distance on the short axis of the floor or between the parallel walls of the channel, as appropriate, and height as the measure of the distance from the surface of the floor 33 to the open top of the channel or top of the channel walls as appropriate.

Figure 2:
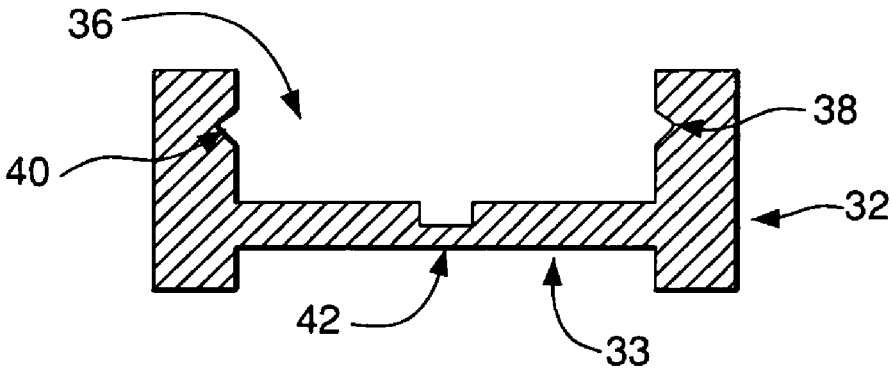
FIG. 2 depicts a cross-section of the wax model of a faux invisible channel setting and illustrates the aperture in the floor of the setting and the grooves in both the walls of the setting and the flange.
Figure 3:
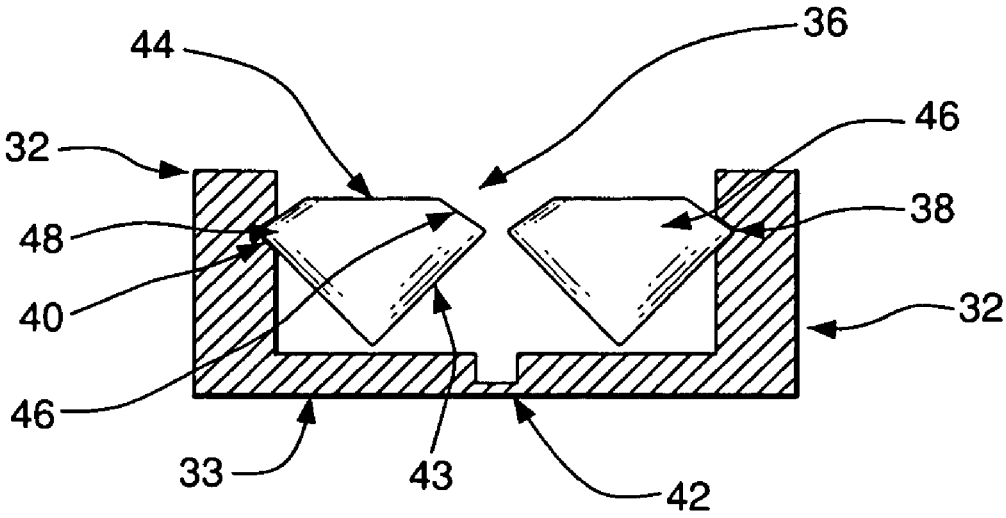
FIG. 3 depicts an example of a flange for securing the gemstones to the wax model.

FIG. 2 depicts a cross section of this model that highlights the location and shape of the apertures in the wax model. They include a first and second groove, 38, 40 for receiving the girdles 46 of the gemstones, and slot 42 for receiving the flange 50. The first and second groove 38, 40 are located near the top of the interior surface of two of the parallel sections of the channel wall 32, and are shaped to substantially conform to the girdles of the gemstones to be placed in the setting. As shown in FIG. 2 and FIG. 3, the first and second grooves 38, 40 have a v-shaped cross section with an angle that corresponds to the angular profile or shape of the edges of the gemstones' girdles 46. Slot 42 for receiving the flange is located on the setting floor is an indentation in the floor along its long axis, approximately midway between and substantially parallel to the parallel sections of the channel wall 32.

As shown in FIG. 3, the gemstones are placed into the wax model in two rows. The gemstones can be square cut diamonds, and for reference herein, the orientation of the gemstones is described as follows. The pavilion 43 is the lower portion of the gemstone and is the portion which placed facing the setting floor 33; the crown 44 is the upper portion of the gemstone, and is placed facing the direction of the open top of the channel cavity 36. The girdle 46 of the gemstone is the equatorial portion of the stone which divides the lower portion from the upper portion. As shown in FIG. 1 and FIG. 2, the gemstones are placed in two rows so that at least one side of the gemstones' girdles 46 are inserted into and engaged by the first or second groove 38, 40 in the channel walls. The girdles 46 otherwise abut one another, except the sides of the girdles opposite the side engaged by the grooves 38, 40, so that a narrow gap above the slot 42 in the floor 33 is left between the girdles to form two rows of gemstones.

Although the embodiment depicted has two rows of gemstones, it is understood that the method of the invention includes methods to produce settings with additional rows of gemstones, for example, by increasing the width of the channel cavity relative to the size of the gemstones and by adding additional slots along the channel floor, and by inserting more than one flange into the wax model. In these settings, one or more rows of gemstones will include stones that are engaged on two sides by a wax flange instead of by a wax flange and a wall.

Further, although the embodiment is depicted using square cut diamonds, a wide variety of gemstones and cuts are contemplated for use in the method. Gemstones include both precious and semi-precious stones, such as diamonds, sapphires, emeralds and other beryls, rubies, amethysts, garnets, topazes, spinels, and the like, while the shape of the gemstone is understood to be selected from the esthetically pleasing shapes appropriate for the particular stone, e.g. square, marquis, baguette, oval, and the like.

Figure 4:
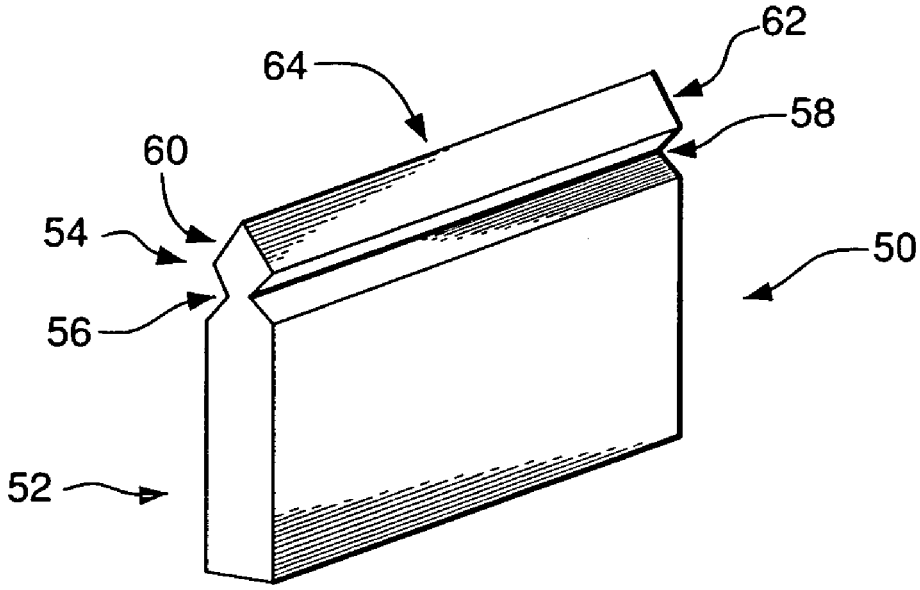
FIG. 4 depicts a cross-section of a wax model of the faux invisible channel setting and illustrates the placement of two rows of gemstones in the channel.
Figure 5:
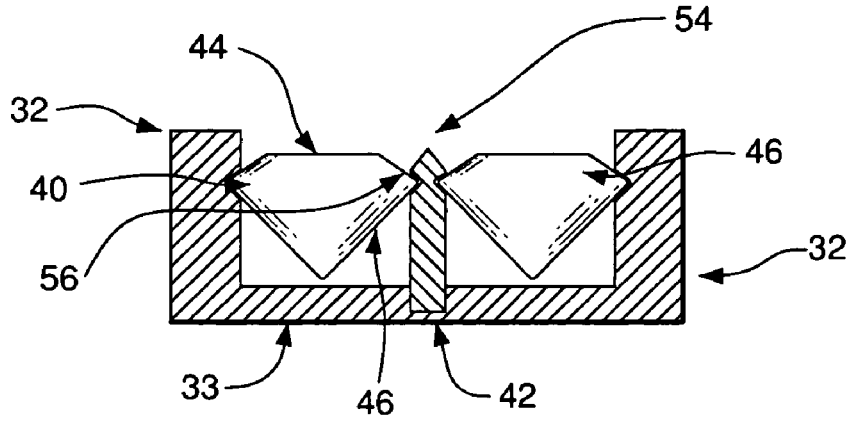
FIG. 5 depicts a cross section of the same faux invisible channel setting with the flange for securing the gemstones placed on the floor of the setting between the rows of gemstones.

The step of adding a flange to the wax model is preferably accomplished as follows. As illustrated by FIGS. 4 and 5, the flange 50 is placed in the wax model of channel setting 30 depicted in FIGS. 1 to 3. The flange 50 is generally rectangular in shape lengthwise, but in cross section, the flange has a base 52 and a head 54. The head 54 and base 52 are separated by a narrow section, a first and second rabbet 56, 58, that are v-shaped grooves in cross section, for engaging the girdles of the gemstones on the sides of the stones that face each other. The first and second rabbet 56, 58 are opposite the grooves 38, 40 on the parallel sections of the channel wall 32. The head 54 has sloping sides 60, 62, that are angled to reflect incident light to and from the view, flange, and gemstone, and meet to form a ridge 64.

The flange may be conveniently formed from the same wax material as the wax model prior to placement in the setting. The flange is added to the setting so that its base 52 is in substantial contact with the floor 33 of the wax model of the channel setting 30. As shown in FIG. 4, the lower part of the base 52 is inserted into and engaged by slot 42, and the first and second rabbets 56, 58, engage and secure the girdles of the gemstones. The height of the ridge 64 is between the plane of the girdles 46 of the gemstones, the plane of the uppermost points or tables formed by the crowns 44 of the gemstones.

Although the flange is depicted herein as a symmetrical piece, and engages two rows of gemstones that are substantial identical in shape, it is contemplated that the shape of the flange, the rabbets 56, 58, or the head 54, may be altered to correspond to different gemstones shapes, for example, by moving, widening or deepening all or a portion of one or both of the rabbets. In addition, for curved channel settings, or curved rows of gemstones, the flange 50 may be similarly curved so that it engages the rows of gemstones and correspond to the curve in the wax model's channel walls 32 and floor 33. For example, if the channel wall 32 forms a circular enclosure around a planar floor 33, and the rows of stones are placed in concentric rings, flange 50 will be arced or circular in shape. Similarly, if the floor 33 and walls 32 of the setting are curved, for example, in an S-shaped channel setting with a planar floor, or in a ring or partial ring shaped channel setting with an arced floor, the flange 50 should be similarly curved or arced, as long as the flange 50 engages the gemstones placed in the setting and extends above the girdles 46 of the gemstones.

As illustrated by FIG. 5, the flange is inserted from the top of the setting, through the gap 48 in the rows of gemstones and into the slot 42 on the floor 33 of the wax model of the setting 30, and the girdles 46 of the gemstone are engaged by the first and second rabbets 56, 58 on the flange 50. It is also contemplated that the flange may preferably be inserted from the side of the model, through a gap or opening (not depicted) in the side of the channel wall 32, so that the base is slid into the slot on the floor, and the first and second rabbets 56, 58 slide between and sequentially engage the girdles of the gemstones.

Preferably, a mold is formed around the wax model of the setting and secured gemstones using standard lost wax techniques. The mold may be formed by encasing the wax model in an investment material, such as a plaster-silica mixture. For example, several wax models may be encased in a single mold by placing the models on the branches of a wax mold tree, with appropriate mold pins extending from the tree to form the inlet and outlet holes, and then encasing the wax tree and wax models by dipping them into a slurry of the investment material. After the investment material has cured, the wax model and tree are removed, leaving a mold cavity with leave cavities identical in shape to the wax model.

Depending on the tolerances of the mold and gemstones, the wax may be removed by melting it with moderate heat, incinerating it in a furnace, or dissolving it with a solvent. After the wax is removed, molten 14 karat gold is injected into the mold through inlet holes until the metal fills the mold cavity. Other metals may also be used, such as higher and lower karat gold, platinum, gold alloys such as white gold, or silver. The mold is allowed to cool, the tree and settings are divested from the mold, and the settings are removed from the branches of the tree. The settings are then polished, and if appropriate, finished into jewelry items.

Figure 6:
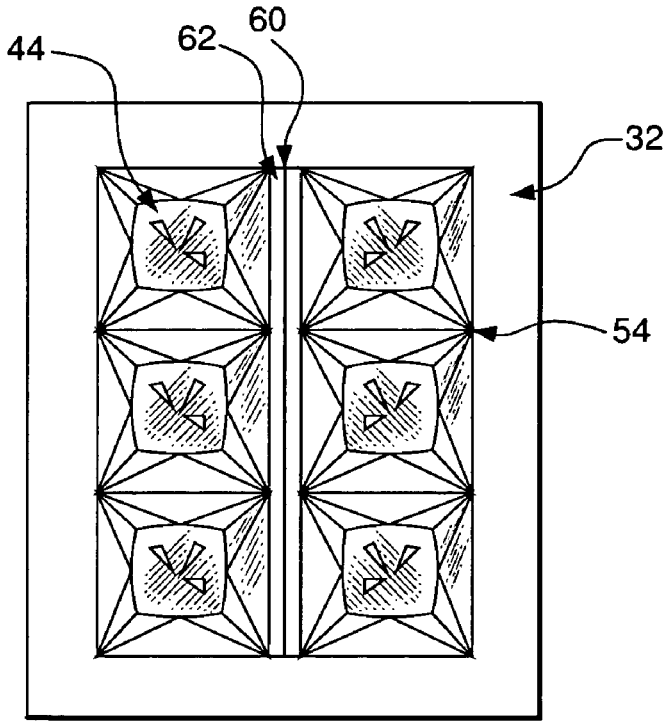
FIG. 6 depicts an overhead view of the simple faux invisible channel setting produced by the method of the invention.

FIG. 6 depicts a magnified overhead view of a channel setting produced by the method of the invention, and illustrates that the head 54 of the flange 50 is the only visible portion of the flange 50. The top of the head does not substantially extend above the upper surface of the crown of the stones, and the sides 60, 62 of the head 54 are angled to reflect light towards the stones and to reflect light from the stones towards the viewer. As a result, the head 54 of the flange 50 is substantially concealed among but not beneath the crowns 44 of gemstones.

An additional, optional finishing step may also be performed to improve this concealment after the jewelry setting has been formed by coating the sides 60, 62 of the head 54 with a reflective metal, one that is closer in hue to the stones than the metal used in the setting, more reflective than the metal used in the setting, or both, such as gold, white gold, rhodium, silver, iridium, platinum or colored alloys of these metals.

Figure 7:
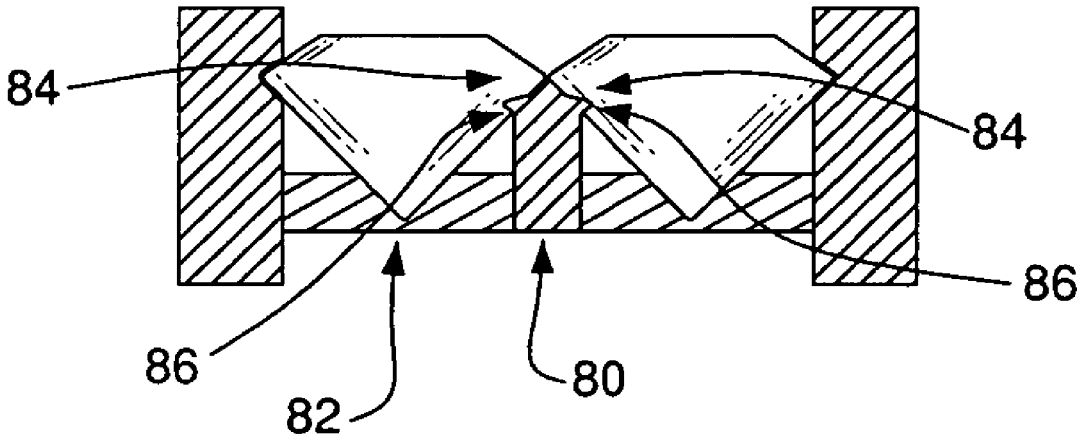
FIG. 7 depicts a cross section of a conventional invisible channel setting produced by conventional methods to illustrates how the means to secure the gemstone depends upon the precise engagement of a concealed anchor on the floor of the setting and a concealed cut on the underside of the gemstones.

FIG. 7 depicts a comparative example, a magnified cross section of a conventional invisible setting produced by conventional methods. A hidden anchor 80 secures the gemstones to the floor 82 of the conventional invisible setting by the engagement of a seam 84 and an inclusion 86 previously cut in the pavilion of the stone by a lapidary. As a result, the secure placement of the gemstones in this conventional setting depends on the precision of the fit between the inclusion 86 and the seam 84.

Moreover, since the seam and anchor of the conventional invisible setting are crafted in the master setting, and then copied in the wax models, small defects and variances in the master or wax model can lead to larger defects in the investment mold. Exceedingly careful quality control and inspection of the models is necessary to catch the defective or damaged wax models, which otherwise produce invisible settings with improperly secured gems. Since both the inclusion 86 and the seam 84 are hidden from view after the stones are placed in the wax model, quality control during and after the production of this setting may be imperfect.

In contrast, the method of the present invention substantially alleviates these problems, since the flange can be inspected both before, and in relevant part, after it has been added to the wax model. At the same time, although the method produces a faux invisible setting, this setting is comparable in appearance and esthetic value to the conventional invisible setting since the visible portion of the flange is concealed and disguised by its shape, size and placement between the stones.

EXAMPLE

An investment mold of faux invisible setting was formed using the above methods. Distilled water and investment material (Gold Star XL, Hoben, England) was mixed in a 40:100 ratio. The material was vacuum treated for 4 minutes, mixed with the appropriate amount of water and allowed to solidify and cool around a wax model of a faux invisible setting with gemstones affixed to the setting by the flange as described above.

The wax was then removed at an increasing elevated temperature and at a reduced pressure, first with an oven temperature 200° C. for 60 minutes, then for 350° C. for 90 minutes, then at 550° C. for 120 minutes and finally at 620° C. for another 180 minutes.

Molten gold is then poured into the mold cavity, while the investment material is still at 620° C. with the reduced pressure maintained.

Finally, the mold is allowed to cool to 50° C., and the investment material is removed, and final finishing of the gold casting of the jewelry piece is performed.

It will be readily apparent to those skilled in the art that the embodiments described herein may be modified or revised in various ways without departing from the spirit and scope of the invention. The scope of the invention is to be measured by the appended claims.

I claim:

1. A method of securely mounting gemstones into an effectively invisible jewelry setting, comprising:

producing a wax model of the jewelry setting;

placing a plurality of gemstones in said wax model;

adding a wax flange for securing the gemstones to the wax model, wherein said flange is placed between said gemstones;

forming a mold from the wax model;

removing the wax model from the mold, thereby forming a mold cavity; and filling the mold cavity with molten metal to produce a jewelry setting having a metal flange for securing the gemstones substantially but not entirely concealed within the setting beneath the gemstones.

2. The method of claim 1, wherein said flange includes a base, a head located at the top of said base, and a narrow portion between said head and said base, wherein, upon being placed between said gemstones, the bottom of said base is in contact with a floor of the setting, said base is concealed by the gemstones, and the girdle of said gemstones fit into the narrow portion of the flange.

3. The method of claim 2, wherein the upper surfaces of said head are sloped to form a ridge.

4. The method of claim 3, further comprising coating the two upper surfaces of the head of the metal flange with a reflective metal.

5. The method of claim 4, wherein said reflective metal is white gold, platinum, iridium, rhodium or an alloy comprising one or more of these metals.

6. The method of claim 1, wherein said setting further includes parallel walls and a floor, said flange, parallel walls and floor are curved to form a wax model of a curved channel setting enclosure.

7. A method for producing an effectively invisible jewelry setting for gemstones, comprising, producing a wax model of the jewelry setting with at least two parallel walls and a floor, said at least two parallel walls having a groove along their opposing interior surfaces, and said floor having a slot positioned between said two parallel walls;

placing a series of gemstones in the wax model of the setting to produce a first and second row of gemstones;

inserting a flange between the first and second rows of gemstones and into said depression on the floor of the wax model, said flange extending to a height above the floor of the wax model to a level above the plane of the girdles of said rows of gemstones;

forming a mold from the wax model;

removing the wax from the mold; and filling the mold with a molten metal to produce an effectively invisible jewelry setting.

8. The method of claim 7, wherein said flange includes a base, a head located at the top of said base, and a first and second rabbet located on opposite sides of the flange and between said base and said head, wherein, upon being placed between said gemstones, the bottom of said base is in contact with the floor of the setting, said base is concealed by the gemstones, and the girdles of said gemstones fit into the rabbets of the flange.

9. The method of claim 8, wherein the upper surfaces of said head are sloped together to form a ridge.

10. The method of claim 9, further comprising the step coating the head of the flange in the effectively invisible setting with a reflective metal, thereby concealing the head of the flange.

11. The method of claim 10, wherein said reflective metal is white gold, platinum, iridium, rhodium or an alloy comprising one or more of these metals.

12. A method for producing an effectively invisible channel setting, comprising, producing a wax model of the jewelry setting including at least two parallel walls integrally formed with and at right angles to a floor, said at least two parallel walls having a first and second groove along their opposing interior surfaces, and said floor having an aperture between said two parallel walls;

placing gemstones in the wax model of the setting to form a first and a second row of gemstones;

inserting a flange between the first and the second row of gemstones and into said aperture on the floor of the wax model, said flange including a head, a base, and a narrow portion for engaging the girdles of the first and second rows of gemstones;

casting an investment mold around the wax model;

removing the wax model from the mold; and filling the mold with a molten metal, thereby forming an effectively invisible setting for the gemstones.

13. The method of claim 12, wherein upon being placed between said gemstones, the base of said flange is concealed by the gemstones, and the head of said flange is above the plane of the girdle of the gemstones.

14. The method of claim 12, wherein the sides of the head of said flange are sloped to form a ridge.

15. The method of claim 12 further comprises the step of coating the top of the head of the flange in the effectively invisible setting with a reflective metal.

16. The method of claim 15, wherein said reflective metal is white gold, platinum, iridium, rhodium or an alloy comprising one or more of these metals.

17. The method of claim 12, wherein said parallel walls and floor form a wax model of a curved channel setting.

18. The method of claim 12, wherein said parallel walls and floor form a wax model of a square channel setting.

* * * * *